US006477968B2

(12) United States Patent
Powell

(10) Patent No.: US 6,477,968 B2
(45) Date of Patent: Nov. 12, 2002

(54) COMBINED DRY DOCK AND BOAT LAUNCHING APPARATUS

(76) Inventor: Larry James Powell, 64 N. Caliboque Rd., Hilton Head, SC (US) 29928

( * ) Notice: Subject to any disclaimer, the term of this patent is extended or adjusted under 35 U.S.C. 154(b) by 0 days.

(21) Appl. No.: 09/812,009

(22) Filed: Mar. 19, 2001

(65) Prior Publication Data

US 2001/0015163 A1 Aug. 23, 2001

Related U.S. Application Data

(63) Continuation-in-part of application No. 09/506,372, filed on Feb. 18, 2000, now abandoned.

(51) Int. Cl.[7] ..... B63C 1/06
(52) U.S. Cl. ..... 114/46; 114/263
(58) Field of Search ..... 114/44–46, 263, 114/125; 405/3

(56) References Cited

U.S. PATENT DOCUMENTS

| | | | |
|---|---|---|---|
| 87,291 | A | 2/1869 | Richardson |
| 1,486,257 | A | 3/1924 | Muller |
| 3,114,535 | A | 12/1963 | Burch |
| 3,149,599 | A | 9/1964 | Francis |
| 3,315,627 | A | 4/1967 | Roberts |
| 3,412,702 | A | 11/1968 | Mann |
| 3,610,192 | A | 10/1971 | Mauritzen |
| 3,638,437 | A | 2/1972 | Fakuda |
| 3,895,592 | A | 7/1975 | King |
| 4,018,179 | A | 4/1977 | Rutter |
| 6,131,528 | A | 10/2000 | Meek et al. |

FOREIGN PATENT DOCUMENTS

| | | | |
|---|---|---|---|
| GB | 2 005 603 | A | 4/1979 |

*Primary Examiner*—Sherman Basinger
(74) *Attorney, Agent, or Firm*—Clarence J. Fleming

(57) ABSTRACT

In a first embodiment the combination boat dry dock and boat launching apparatus includes two planar dock sections pivotally connected to each other. The dock sections include cradle straps for supporting the hull of a boat with the longitudinal axis of the boat in substantial parallel relationship with the pivot axis of the dock sections. Each dock section is supported by two pontoons attached at proximal and distal portions of the dock sections. The two pontoons at respective proximal portions of the dock sections may be flooded with water to allow the proximal portions of the dock sections to descend below water level for launching of a boat. Air is introduced into these two pontoons for expelling water and thereby raising the dock sections above the water level. In a second embodiment, a constant buoyancy pontoon is mounted to each dock section intermediate the other pontoons. A pump and conduits transfer water between the proximal and distal pontoons of each dock section.

18 Claims, 4 Drawing Sheets

COMBINED DRY DOCK AND BOAT LAUNCHING APPARATUS

This application is a continuation-in-part of application, Ser. No. 09/506,372, filed Feb. 13, 2000 now abandoned.

BACKGROUND OF THE INVENTION

1. Field of the Invention

The present invention relates to dry docks for boats. In particular the present invention relates to a dry dock which will support a boat with its hull above the waterline and which will permit lowering of the boat hull below the waterline for launching purposes.

2. Description of the Prior Art

The 1869 patent to Richardson, U.S. Pat. No. 87,291, discloses a dry dock with air-tight tanks and a screw-rod mechanism for lowering of a boat into the water and for lifting of the boat from the water. This dry dock has the disadvantage of requiring substantial mechanical forces to operate the screw-rod mechanism.

Muller patent U.S. Pat. No. 1,486,257 shows a dry dock having pontoons which may be partially flooded for tilting of the dry dock. This arrangement results in undesired tilting of a vessel supported by the dry dock.

U.S. Pat. No. 3,114,53 to Burch discloses a boat lift with float units and a pulley arrangement for lifting and lowering of the boat. This boat lift suffers from the use of a somewhat complicated pulley mechanism and the requirement of substantial mechanical forces to operate the pulley mechanism.

Roberts patent U.S. Pat. No. 3,315,627 shows a pneumatically operated floating dry dock. The employed is quite complicated requiring a number of ballast tanks, inflatable rubber bags and multiple valves for operating the tanks and bags.

A floating dry dock for small boats is disclosed in Mann patent U.S. Pat. No. 3,412,702. The Mann patent is similar to the Burch patent mentioned above in that it uses a pulley system for raising and lowering of pontoons. Again, this arrangement has the disadvantage of requiring substantial mechanical forces to operate the pulley system.

Rutter patent U.S. Pat. No. 4,018,179 shows a pontoon system for supporting watercraft on a body of water. This system requires tilting of the pontoons for carrying out a two-step procedure where the front portion of the boat is first lifted followed by raising of the rear portion of the boat.

UK patent application GB 2 005 603 A discloses a floating dock which is variably buoyant and includes a pair of central rotatably mounted caissons to which outrigger floats are attached by arms. This application mentions, but does not show or describe in detail, that working platforms can be attached to the arms. However, the nature of the keel blocks attached to the caissons is such that the platforms could not be continuous and uninterrupted in form. Moreover, the construction of the floating dock in this UK publication is further complicated because the caissons are restricted to rotation about their respective central axes.

For further background of the invention, attention is invited to the following patents: Francis U.S. Pat. No. 3,149,599; Mauritzen U.S. Pat. No. 3,610,192; Fukuda U.S. Pat. No. 3,638,437; King U.S. Pat. No. 3,895,592; and Meek et al. U.S. Pat. No. 6,131,528.

SUMMARY AND OBJECTS OF THE INVENTION

The present invention includes a dry dock advantageously employing an articulated mechanism supported by a plurality of pontoons where one or more of the pontoons may be selectively flooded with water, or filled with a fluid lighter than water, for respectively lowering a boat into the water or lifting of the boat above the waterline.

A primary object of the present invention is the provision of a dry dock of the type just described which takes advantage of buoyancy forces for lifting and lowering of a boat.

A still further object of the present invention is the provision of a variable buoyancy dry dock and boat launching apparatus having a self-contained variable buoyancy system.

Another object of the present invention is the provision of a dry dock which will support a boat with the hull of the boat completely above the waterline and which will permit lowering of the boat into the water for launching purposes.

Still another object of the present invention is the provision of a dry dock of the type described which is of simple and easy-to-manufacture construction.

These and other objects and advantages of the present invention will become apparent from the following description of preferred embodiments.

DESCRIPTION OF THE INVENTION

Figure 1:
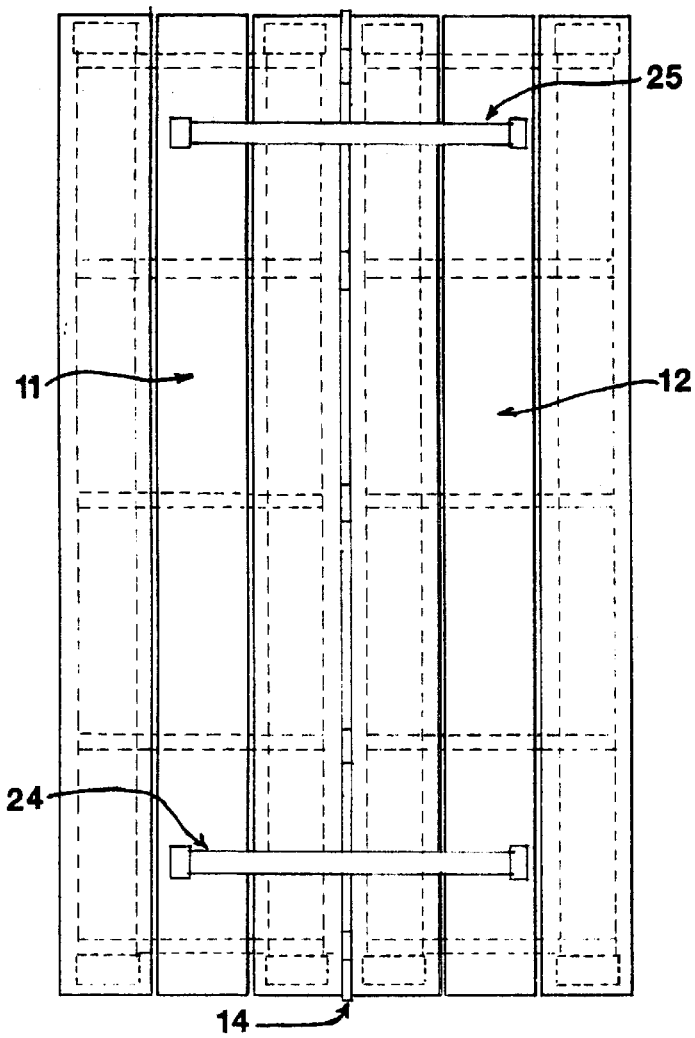
FIG. 1 is an isometric view of the dry dock of a first embodiment of the present invention.
Figure 3:
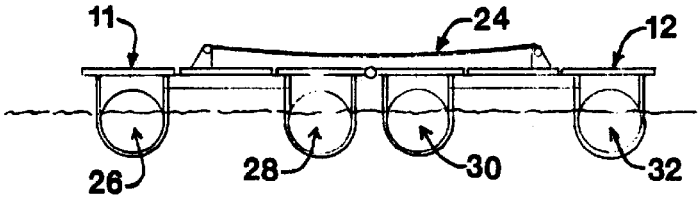
FIG. 3 is an end view of the dry dock in the docking position.

Referring first to the embodiment of FIGS. 1–6, the dry dock of the present invention, generally designated 10, includes a pair of identical planar sections 11 and 12. These sections may be made of wood planks or other suitable material. Each dock section is preferably made from a plurality of planks or boards forming a substantially continuous and uninterrupted deck or planar platform. The sections 11 and 12 are connected together at their proximal portions by a plurality of axially aligned hinge members 14 such that the sections 11 and 12 may pivot about an axis 15.

Section 11 mounts support blocks 16 and 17. Similarly, section 12 mounts support blocks 20 and 21. A hull cradle strap 24 is connected to support blocks 16 and 20. In like manner, a second strap 25 is connected to support blocks 18 and 21. These straps are adapted to engage and support the hull of a boat (not shown) for supporting the same with the longitudinal axis of the hull in parallel relationship with the pivot axis 15. It will be understood that the present invention is primarily, although not exclusively, adapted for docking and launching of small boats. In the case of small boats, the hull may be manually positioned on the support straps 24 and 25 or so positioned by the use of a winch or the like with the longitudinal axis of the hull in substantial parallel relationship with the pivot axis 14.

Dock section 11 is supported by pontoons 26 and 28. Preferably, pontoon 26 is connected to the section 11 at its distal portion; pontoon 28 is connected to section 11 at its proximal portion adjacent the hinge members 14. In the same manner, a pontoon 30 is connected to the proximal portion of the section 12; a pontoon 32 is connected to the dock section 12 adjacent its distal portion. The various pontoons may be connected to the dry dock section by mounting members 34 as best seen in FIG. 6.

The tubular walls and end walls of the pontoons 26, 28, 30 and 32 may be made of metal of plastic material and secured together to form closed chambers. Of course, the pontoons are by their very nature buoyant when filled with air or another fluid lighter than water.

Figure 6:
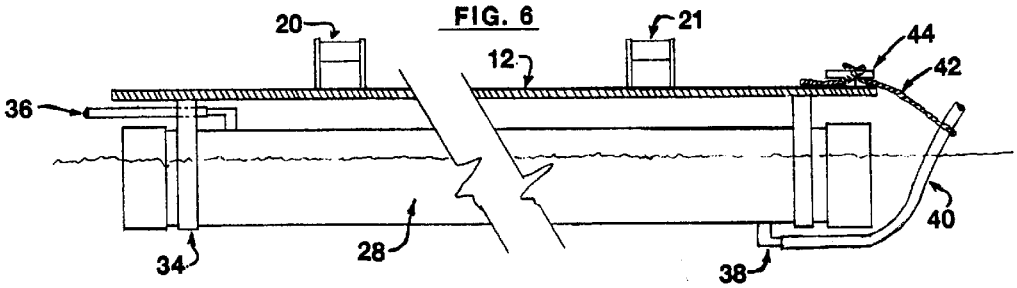
FIG. 6 is an enlarged section taken along line 6—6 of FIG. 1.
Figure 7:
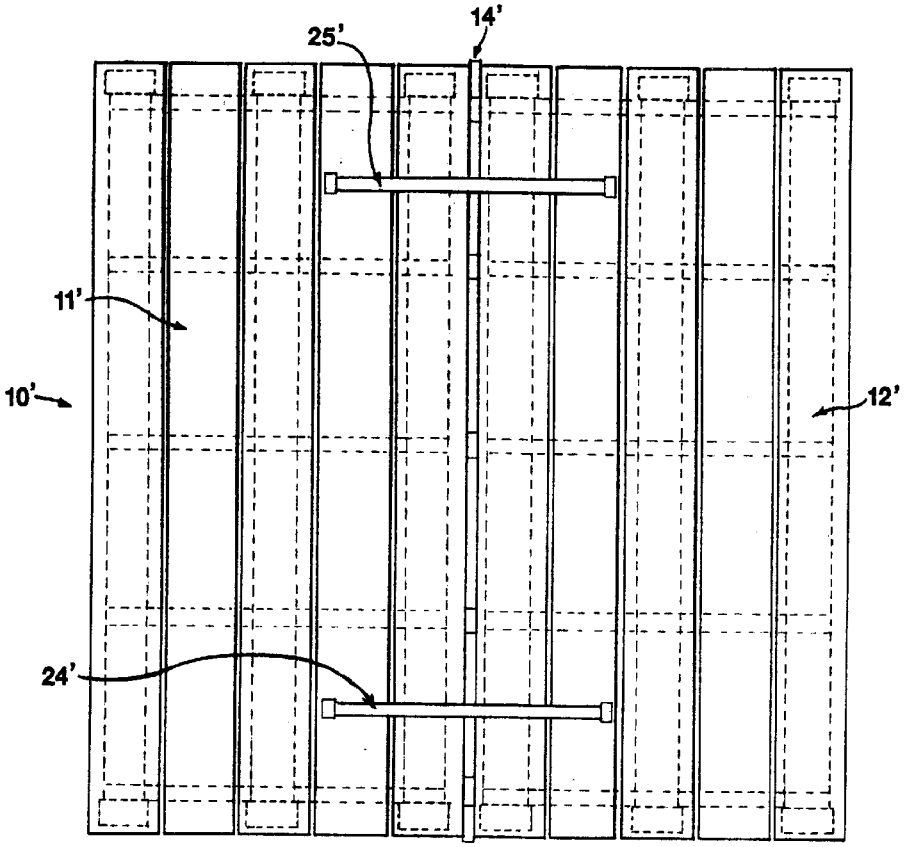
FIG. 7 is a view of a second embodiment of the invention.

Referring to FIG. 6, the pontoon 28 has a first opening (not shown) communicating the interior of the pontoon with an L-shaped tubular member 36. The pontoon 28 has a second opening (not shown) communicating the interior of the pontoon 28 with a second L-shaped tubular member 38. A flexible tubular member, such as a hose section 40, is preferably connected to the L-shaped member 38. A lanyard 42 is connected to the free end of the hose 40 for securing this end of the hose to a cleat 44.

It will be understood that the pontoon 30 is of a construction identical with the pontoon 28 and thus includes a pair of openings communicating the interior of the pontoon with L-shaped tubular members. It should also be understood that the members 36, 38 need not be of L-shape configuration but of any suitable configuration for making connections with flexible tubular members.

The operation of the dry dock of the first embodiment is as follows: When all four pontoons are in a buoyant state, that is to say, the pontoons 28 and 30 are filled with air or other fluid lighter than water, the dock will be in the configuration shown in FIGS. 1–3, 5 and 6 for supporting a boat above the waterline. In this configuration, the free ends of the hoses 40 connected to the pontoons 28 and 30 will be suitably supported above the waterline. When it is desired to launch a boat supported by the dry dock, the lanyards 42 will be released from the cleat 44 and the free ends of the hoses 40 will be placed below the waterline thus allowing the pontoons 28 and 30 to be flooded with water. The dry dock will then assume the configuration shown in FIG. 4 wherein the proximal portions of the sections 11 and 12 descend below the waterline for launching of the boat. The distal portions of the dry dock sections will remain above the waterline due to the buoyancy of the pontoons 26 and 32.

Figure 4:
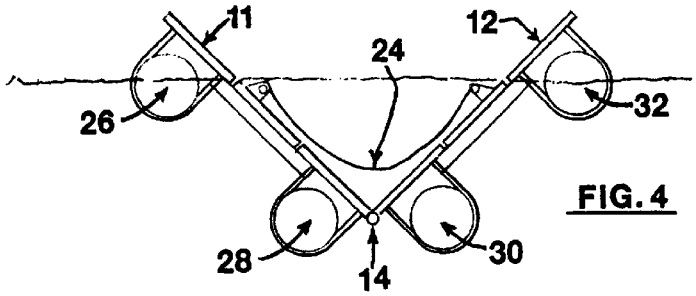
FIG. 4 is an end view of the dry dock in the launching position.
Figure 2:
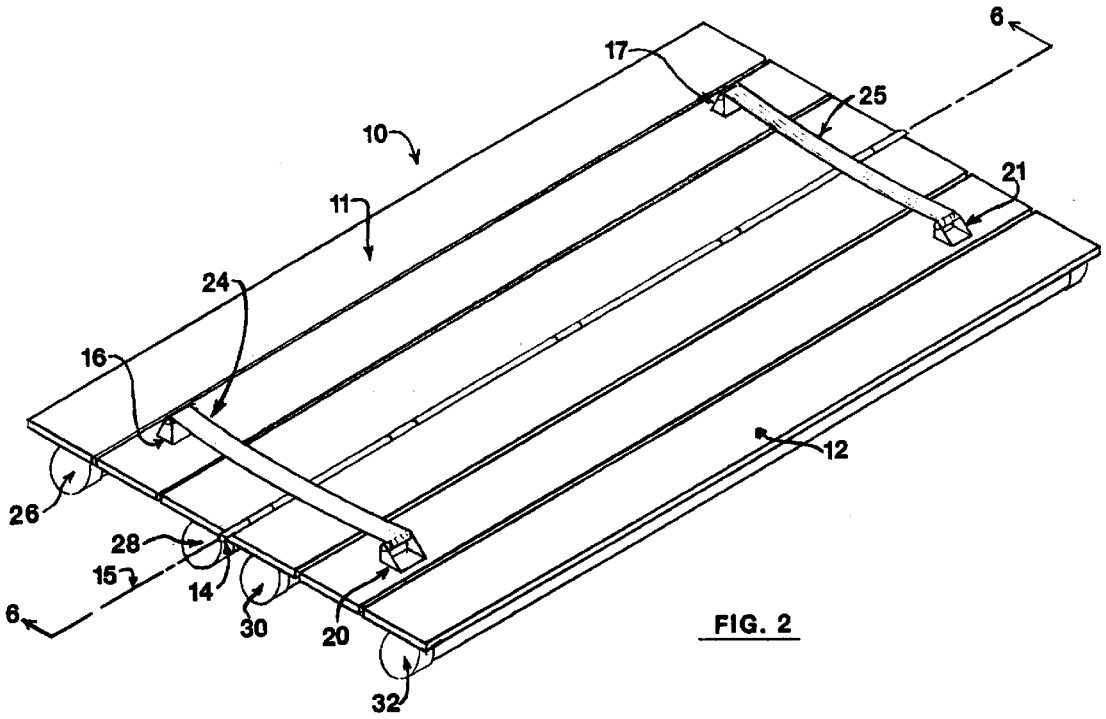
FIG. 2 is a plan view of the dry dock of FIG. 1.
Figure 5:
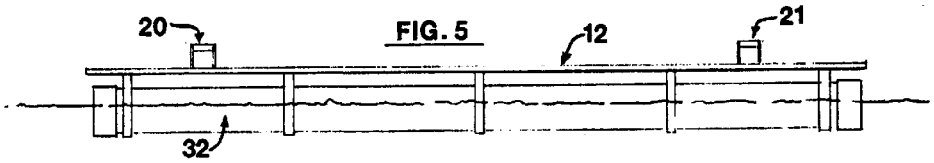
FIG. 5 is a side view of the dry dock in the docking position.

The dry dock may remain in the configuration of FIG. 4 until it is desired to dock the boat. Hoses (not shown) may be attached to the L-shaped tubular members 36 on the pontoons 28 and 30; these hoses will be connected to an air blower for forcing water from the pontoons 28 and 30. The water will be discharged through the L-shape members 38 and the hoses 40. When the pontoons 28 and 30 have been raised to the configuration shown in FIG. 3, the free ends of the hoses 40 will be supported above the waterline by the lanyards 42. When the dry dock has been returned to the configuration shown in FIG. 3, the boat will have been raised and will be supported completely above the waterline.

It should be understood that the distal portion of one of the dock sections 11 or 12 may be supported by attachment to an adjacent dock of conventional construction. In this event, one of the pontoons 26 or 32 may be eliminated. It will also be understood that a somewhat larger single pontoon could be substituted for the two pontoons 28 and 30.

A second embodiment of the invention is shown in FIGS. 7–11. Parts of the second embodiment that correspond to the first embodiment of FIGS. 1–6 are designated by the prime form of numeral.

The dock section 11' has attached thereto a proximal pontoon 28', a distal pontoon 26' and an intermediate pontoon 46. In like manner, the dock section 12' is attached to a proximal pontoon 30', a distal pontoon 32' and an intermediate pontoon 48. The pontoons 26' and 32' are preferably mounted in spaced relationship to the dock sections 11' and 12' by a plurality of legs 50.

A conduit 52, which may be in the form of a pipe or hose, communicates with the interiors of the pontoons 26' and 28'. Similarly, a conduit 54 communicates with the interiors of the pontoons 30' and 32'. A pump 56, shown diagrammatically in FIGS. 8 and 9, may be secured to the underside of the dock section 11' and communicates with the conduit 52. A second pump 58 secured to the underside of the dock section 12' communicates with the conduit 54.

Figure 8:
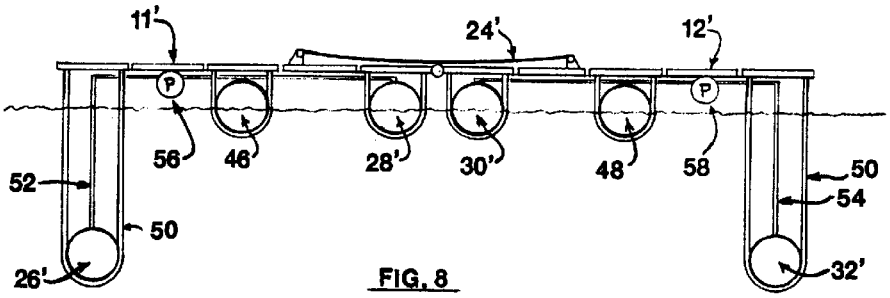
FIG. 8 is an end view of the dry dock of FIG. 7 in the docking position.
Figure 9:
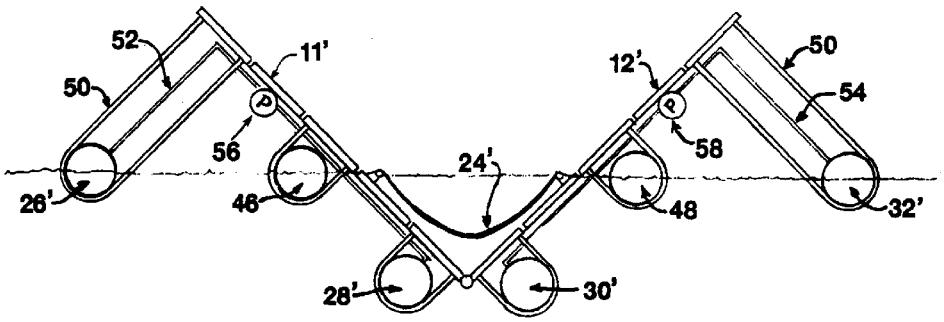
FIG. 9 is an end view of the FIG. 7 dry dock in the launching position.
Figure 10:
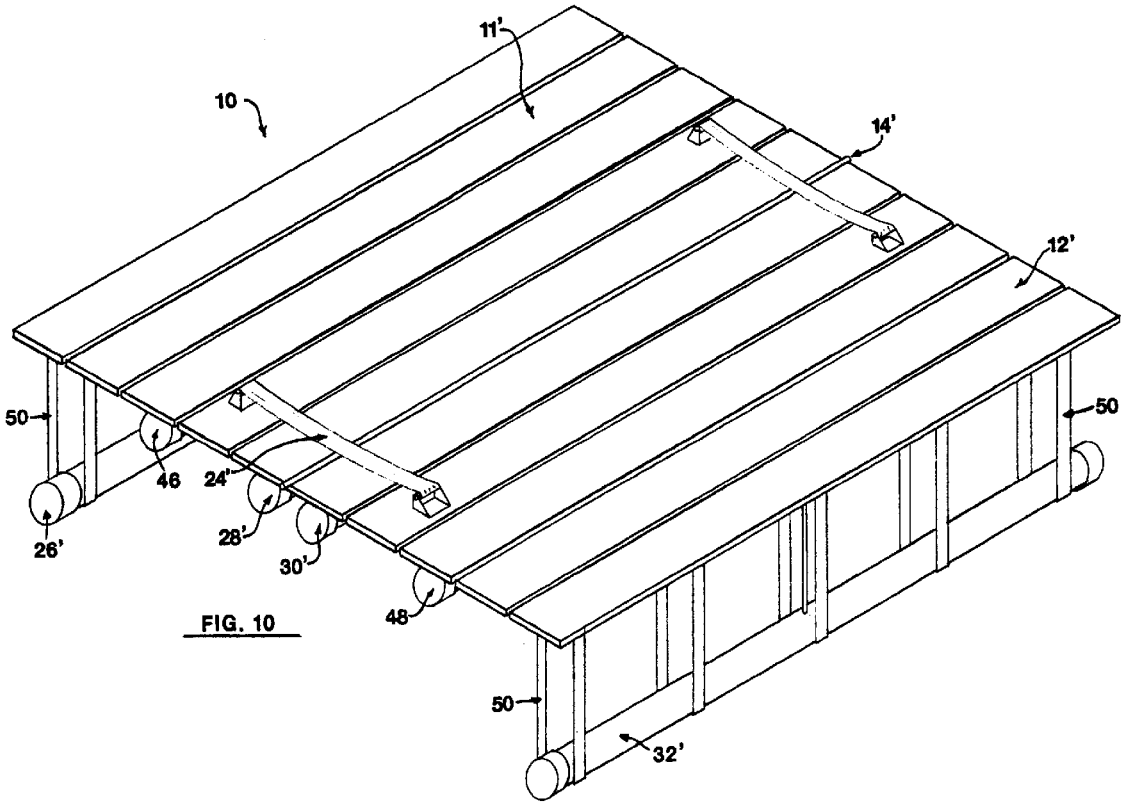
FIG. 10 is an isometric view of the second embodiment of the invention.
Figure 11:
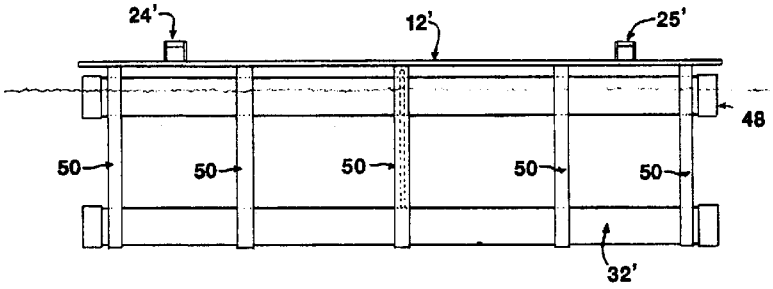
FIG. 11 is a side view of the FIG. 7 embodiment.

In a preferred form of the second embodiment of the invention, a liquid, such as water, having a volume substantially the same as the volume of one on the pontoons 26' or 28', is contained in the pontoon 26' when the dock sections are in the configuration shown in FIG. 8. Another quantity of water, having a volume the same as the volume of one of the pontoon 30' or 32', is contained in the pontoon 32' when the dock sections are in the FIG. 8 configuration. The pump 56 is in communication with the conduit 52 and transfers the self-contained quantity of water from the pontoon 26' to the pontoon 28' and from the pontoon 28' to the pontoon 26'. An additional conduit (not shown) communicates with the pontoons 26' and 28' to permit the passage of air from the pontoon to the pontoon containing the quantity of water. In like manner, the pump 58 in communication with the conduit 54 transfers water from the pontoon 32' to the pontoon 30' and vice-versa. Again, another conduit (not shown) communicates with the pontoons 30' and 32' to permit the passage of air from one pontoon to the other.

The pump 56 may be mounted within one of the pontoons 26', 28' or 46. The pump 58 may also be mounted within one of the pontoons 30', 32' or 48. Alternative, a single pump could be mounted within one of the pontoons. In that even an additional conduits (not shown) would be provided to communicate with the pontoons 28' and 30' so that the single pump could transfer water back and forth between the pontoons 26', 28' and the pontoons 30' and 32'. As is the case with the first embodiment of the invention described above, a single pontoon could replace the pontoons 28' and 30'.

When it is desire to launch a boat using the embodiment of FIGS. 7–11, the pumps 56, 58 will be activated to transfer the self-contained liquid from the pontoons 26' and 32' to the pontoons 28' and 30'. The dock sections will then assume the configuration shown in FIG. 9. When it is desired to raise the dock sections to the configuration shown in FIG. 8, the pumps will be activated to transfer the water from the pontoons 28', 30' to the pontoons 26', 32'. It will be understood that in lieu of the self-contained liquid system of the second embodiment, water could be transferred to and from the pontoons 26', 28' and the pontoons 30', 32' using the system of the first embodiment.

The dock sections 11', 12' may be connected to an existing dock by suitable pivot means (not shown) attached to the dock section adjacent the ends of the intermediate pontoons 46 and 48. By reference to FIGS. 8 and 9, it will be apparent that the dock sections 11' and 12' will pivot about the pontoons 46 and 48, respectively.

Accordingly, it is seen that the present invention provides a dry dock that will support a boat with the hull completely out of the water. The dry dock of the invention permits ready launching and docking of a boat by alternately flooding the pontoons 28 and 30, or the pontoons 28' and 30', and then forcing water from these pontoons.

It is understood that the present invention is not to be limited to the embodiments shown and described herein but rather to all embodiments and modifications coming within the scope of the following claims.

I claim:

1. A combination boat dry dock and boat launching apparatus comprising:

(a) a pair of dry dock sections, each dock section having respective proximal, distal and opposite end portions formed by substantially planar, continuous and uninterrupted means defining a deck;

(b) pivot means connecting said sections together at their proximal portions for pivoting movement about a pivot axis;

(c) cradle means on said dock sections for supporting the hull of a boat with the centerline of the hull in substantial parallel relationship with said pivot axis;

(d) support means attached to the distal portion of one of said dock sections for supporting said distal portion above water level;

(e) buoyant means attached to the distal portion of the other of said dock sections for supporting the distal portion of the other of said dock sections above water level;

(f) wall means defining a closed chamber attached to the proximal portion of at least one of said dock sections; and (g) means attached to said wall means for selectively and alternately establishing buoyant and non-buoyant states for the wall means, whereby the wall means, in its buoyant state, supports the dock sections above water level and, in its non-buoyant state, allows the proximal portions of said dock sections to descend below the water level.

2. The apparatus according to claim 1 wherein said support means comprises a pontoon.

3. The apparatus according to claim 1 wherein said buoyant means comprises a pontoon.

4. The apparatus according to claim 1 wherein said wall means comprises a pontoon including at least one opening therein.

5. The apparatus according to claim 4 further defined by a flexible tubular member attached at one end thereof to said pontoon and communicating with said one opening.

6. The apparatus according to claim 5 further defined by fastening means attached to said tubular member at an end remote from said one end for securing said last-mentioned end of the tubular member to said dock sections.

7. The apparatus according to claim 4 wherein said pontoon includes a second opening.

8. The apparatus according to claim 1 further defined by second wall means defining a closed chamber and attached to the proximal portion of the other of said dock sections.

9. The apparatus according to claim 8 wherein said second wall means comprises a pontoon having at least one opening therein.

10. The apparatus according to claim 1 wherein said dock sections are substantially planar.

11. The apparatus according to claim 1 wherein said cradle means includes straps for receiving the hull of a boat.

12. A combination boat dry dock and boat launching apparatus comprising:

(a) a pair of dry dock sections having respective proximal and distal portions;

(b) pivot means connecting said sections together at their proximal portions for pivoting movement about a pivot axis;

(c) cradle means on said dock sections for supporting the hull of a boat with the centerline of the boat hull in substantial parallel relationship with said pivot axis;

(d) first and second variable buoyancy means attached to respective distal portions of said dock sections for supporting said distal portions above water level;

(e) third variable buoyancy means attached to the proximal portion of at least one of said dock sections;

(f) first and second constant buoyancy means attached to respective dock sections intermediate their proximal and distal portions;

(g) conduit means connecting said first and second variable buoyancy means with said third variable buoyancy means; and (h) further means communicating with said conduit means for varying the buoyancy of said first, second and third buoyancy means thereby to pivot said dock sections about said pivot axis.

13. The apparatus according to claim 12 wherein said first and second variable buoyancy means are defined by pontoons.

14. The apparatus according to claim 12 wherein said conduit means and said further means are adapted to transfer a liquid between the first variable buoyancy means and the third variable means on the one hand and the second variable buoyancy means and the third variable buoyancy means on the other hand.

15. The apparatus according to claim 12 wherein said further means comprise pumping means.

16. The apparatus according to claim 12 wherein said dock sections are substantially continuous and planar members.

17. The apparatus according to claim 12 wherein said cradle means includes straps for receiving the hull of a boat.

18. The apparatus according to claim 12 wherein said third variable buoyancy means is in the form of a pontoon.

* * * * *